US011209758B2

(12) United States Patent
Kopp et al.

(10) Patent No.: US 11,209,758 B2
(45) Date of Patent: Dec. 28, 2021

(54) PRINTING DEVICE HAVING AN ADJUSTABLE FUSER

(71) Applicant: Canon Production Printing Holding B.V., Venlo (NL)

(72) Inventors: Christian Kopp, Planegg (DE); Georg Landmesser, Haar (DE); Bernhard Hochwind, Munich (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/870,199

(22) Filed: May 8, 2020

(65) Prior Publication Data

US 2020/0356031 A1 Nov. 12, 2020

(30) Foreign Application Priority Data

May 10, 2019 (DE) ..... 102019112288.0

(51) Int. Cl.
*G03G 15/20* (2006.01)

(52) U.S. Cl.
CPC ..... *G03G 15/2039* (2013.01); *G03G 15/2007* (2013.01)

(58) Field of Classification Search
CPC ..... G03G 15/2039; G03G 15/2007; B41J 11/002; B41J 2/01; B41J 2/17
See application file for complete search history.

(56) References Cited

U.S. PATENT DOCUMENTS

2005/0259981 A1 11/2005 Yip et al.
2010/0086692 A1 4/2010 Ohta
2020/0156389 A1* 5/2020 Kojima ..... B41J 11/002
2020/0282758 A1* 9/2020 Freudenberg ..... B41J 11/002

FOREIGN PATENT DOCUMENTS

DE 102017124114 A1 4/2019

OTHER PUBLICATIONS

English translation of DE 102017124114 A1 (with publication date of Apr. 18, 2019) printed on May 21, 2021.*
German Action dated Mar. 14, 2020, Application No. 10 2019 112 288.0.

* cited by examiner

*Primary Examiner* — Sophia S Chen
(74) *Attorney, Agent, or Firm* — Schiff Hardin LLP

(57) ABSTRACT

A printing device includes an applicator with which a test fluid is applied onto a recording medium to be printed to, as well as an absorption measurement system with which absorption data are acquired with regard to the absorption rate of the test fluid. The printing device also includes a fuser to fix a print image printed by the printing device. The fuser is adjusted depending on the acquired absorption data so that an optimal and/or desired fixing of print images on the respectively used type of recording medium is produced.

20 Claims, 6 Drawing Sheets

PRINTING DEVICE HAVING AN ADJUSTABLE FUSER

CROSS REFERENCE TO RELATED APPLICATIONS

This patent application claims priority to German Patent Application No. 102019112288.0, filed May 10, 2019, which is incorporated herein by reference in its entirety.

BACKGROUND

Field

The disclosure relates to the fixing of a print image printed onto a recording medium by a printing device, in particular by an inkjet printing device. In particular, the disclosure relates to the adaptation of fixing parameters of a fixing process for fixing a print image to the respectively used type of recording medium and/or to the respectively used print color and/or to a coating substance that is used.

Related Art

A printing device, in particular an inkjet printing device, for printing to a recording medium may include one or more print heads respectively having one or more nozzles. The nozzles are respectively configured to eject ink droplets in order to print dots of a print image onto the recording medium. The one or more print heads and the recording medium are thereby moved relative to one another in order to ink dots onto the recording medium at different positions, in particular in different lines, and in order to thus print a print image on the recording medium. The print image is typically fixed in a fixer, which may also be referred to as a fuser.

Given inks, in particular given latex inks, the robustness of a print image and the possibilities for post-processing of the print image, for example coating, are influenced by—among other things—the proportion of cosolvent (for example glycerin) that remains in the fixed ink layer following the fixing. The robustness of the print image typically increases with a decreasing proportion of cosolvent. Due to the relatively low evaporation rate of cosolvent, cosolvent must for the most part be absorbed into the recording medium within the scope of the fixing in order to reduce the proportion of cosolvent in the fixed ink layer. The proportion of cosolvent that may be absorbed by the recording medium is thereby influenced by the quantity of ink that is to be absorbed in total, and by properties of the ink, of the recording medium, and/or of the fixing process.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

FIG. 1*a* is a block diagram of an inkjet printing device according to exemplary embodiment.

FIG. 1*b* is a block diagram of a dryer or fuser for an inkjet printing device according to exemplary embodiment.

FIG. 1*c* is a block diagram of a convection dryer for the dryer or fuser according to exemplary embodiment.

FIG. 1*d* is a block diagram of a radiant dryer for the dryer or fuser according to exemplary embodiment.

FIGS. 2*a* through 2*c* illustrate printing devices having an absorption measurement system according to exemplary embodiments.

Figure 1A:
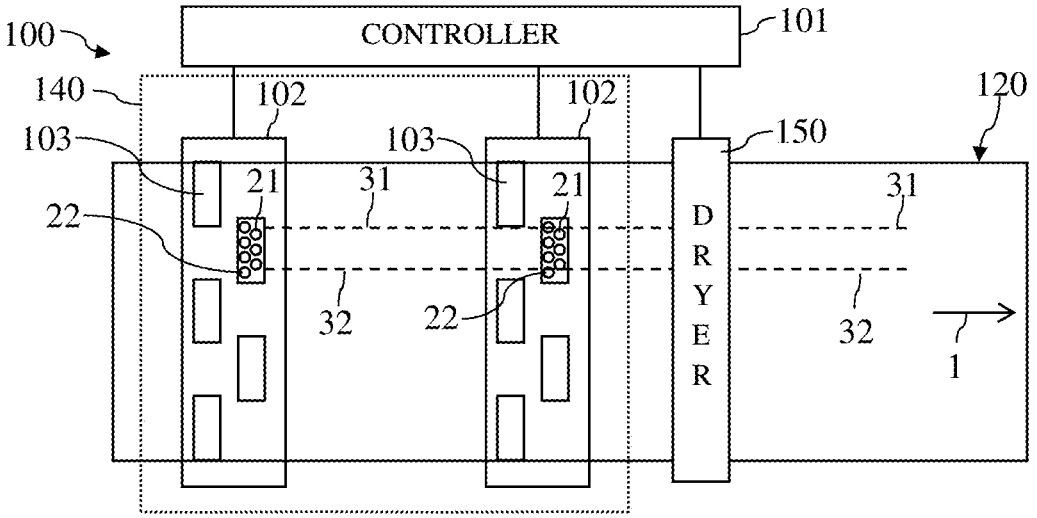

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to provide a printing device for printing of robust print images that may be efficiently adapted to different types of recording media and/or to different types of print colors (in particular inks).

According to one aspect of the disclosure, a printing device (printer) is described for printing to a recording medium. In an exemplary embodiment, the printing device includes at least one print head that is configured to apply or to print print color for a print image onto the recording medium. Furthermore, the printing device includes a fuser that is configured to execute a fixing process in order to at least partially fix the print image onto the recording medium. The fuser has one or more adjustable fixing parameters via which the fixing process may be varied. Moreover, the printing device includes an application means that is configured to apply a test fluid onto the recording medium, as well as an absorption measurement system that is configured to acquire absorption data in relation to the absorption rate with which the test fluid is absorbed by the recording medium. The printing device also includes a controller that is configured to determine values of the one or more fixing parameters on the basis of the absorption data. The fixing process may thus be efficiently and reliably adapted to the recording medium that is used and/or to the print color that is used.

FIG. 1*a* illustrates a printing device 100 according to an exemplary embodiment. The printing device 100 is configured to print to a recording medium 120 in the form of a sheet or page or plate or belt. The recording medium 120 may be produced from paper, paperboard, cardboard, metal, plastic, textiles, a combination thereof, and/or other materials that are suitable and can be printed to. The recording medium 120 is directed through the print group 140 of the printing device 100 along the transport direction 1, which is represented by an arrow.

In the depicted example, the print group 140 of the printing device 100 includes two print bars 102, wherein each print bar 102 may be used for printing with ink of a defined color, for example black, cyan, magenta, and/or yellow, and if applicable MICR ink. Different print bars 102 may be used for printing with respective different inks. Furthermore, the printing device 100 typically includes at least one fixing or dryer 150 that is configured to fix a print image printed on the recording medium 120.

In an exemplary embodiment, a print bar 102 includes one or more print heads 103 that are arranged side by side in a plurality of rows in order to print the dots of different columns 31, 32 of a print image onto the recording medium 120. In the example depicted in FIG. 1, a print bar 102 includes five print heads 103, wherein each print head 103 prints the dots of one group of columns 31, 32 of a print image onto the recording medium 120. The number of print heads 103 of a print bar 102 may be 5 or more or 10 or more, for example.

In the embodiment depicted in FIG. 1*a*, each print head 103 of the print group 140 includes a plurality of nozzles 21, 22, wherein each nozzle 21, 22 is configured to fire or eject ink droplets onto the recording medium 120. A print head 102 of the print group 140 may, for example, include multiple thousands of effectively utilized nozzles 21, 22 that are arranged along multiple rows transversal to the transport direction 1 of the recording medium 120. By means of the nozzles 21, 22 of a print head 103 of the print group 140, dots of a line of a print image may be printed on the recording medium 120 transversal to the transport direction 1, meaning along the width of the recording medium 120.

In an exemplary embodiment, the printing device 100 also includes a controller 101, for example an activation hardware and/or a controller, that is configured to control the actuators of the individual nozzles 21, 22 of the individual print heads 103 of the print head 140 in order to apply the print image onto the recording medium 120 depending on print data. In an exemplary embodiment, the controller 101 includes processor circuitry that is configured to perform one or more functions and/or operations of the controller 101, including controlling the actuators of the individual nozzles and/or controlling the overall operation (e.g. one or more operations) of the printing device 100.

The print group 140 of the printing device 100 thus includes at least one print bar 102 having K nozzles 21, 22, wherein the nozzles 21, 22 may be arranged in one or more print heads 103, and wherein the nozzles 21, 22 may be activated with a defined line clock cycle or with a defined activation frequency in order to print a line that travels transversal to the transport direction 1 of the recording medium 120, with K pixels or K columns 31, 32 of a print image, onto the recording medium 120, for example with K>1000. In the depicted example, the nozzles 21, 22 are installed immobile or fixed in the printing device 100, and the recording medium 120 is directed past the stationary nozzles 21, 22 with a defined transport velocity.

As presented above, in an exemplary embodiment, the printing device 100 includes a dryer or fuser 150 that is configured to dry the recording medium 120 after application of the ink by the one or more print bars 102, and therefore to fix the applied print image onto the recording medium 120. For this, the dryer or fuser 150 may be controlled by a controller 101 of the printing device 100. For example, the dryer or fuser may take place depending on the quantity of applied ink and/or depending on a type of the recording medium 120, in particular depending on absorption properties of the recording medium 120 that is used.

Figure 1B:
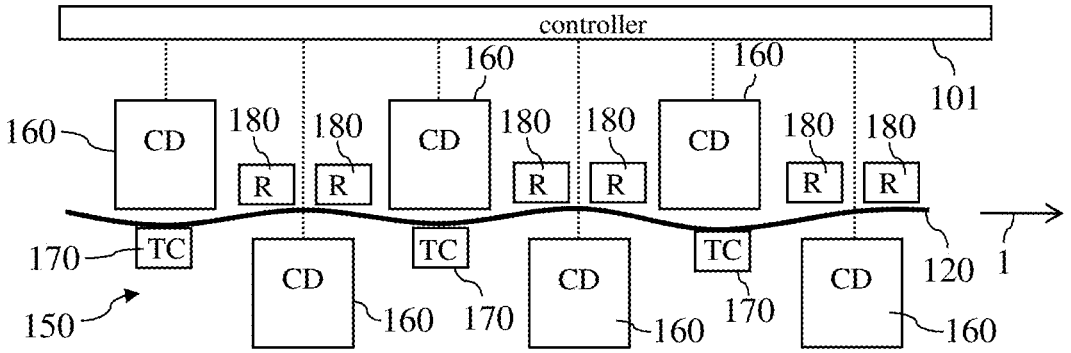

The dryer or fuser 150 according to an exemplary embodiment as shown in FIG. 1*b* includes a plurality of drying or fixing modules 160, 170, 180 that are arranged along a drying route on both sides of the recording medium 120, for example a recording medium 120 in the form of a web. In particular, the dryer or fuser 150 may include one or more convection dryers 160 that are respectively configured to blow a gaseous drying medium, typically heated air, onto the surface of the recording medium 120. The print image on a recording medium 120 may thus be gently and reliably dried along the drying route of the dryer or fuser 150. If applicable, the drying energy and/or the drying performance of the individual dryers 160 may thereby be individually adjusted.

Figure 1C:
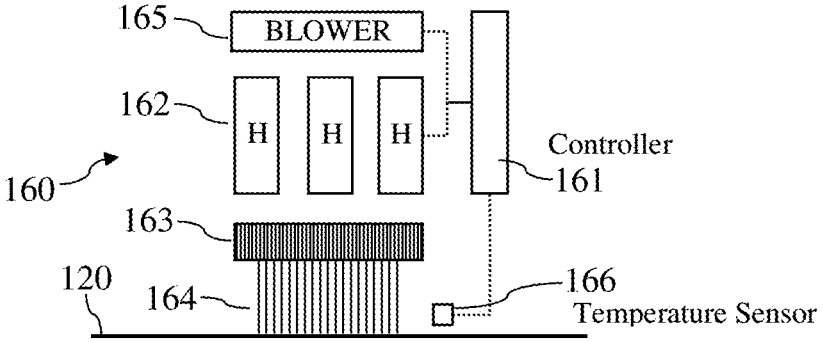

FIG. 1*c* shows a block diagram with examples of components of a convection dryer 160 according to an exemplary embodiment. The convection dryer 160 depicted in FIG. 1*c* includes a blower 165 with which the gaseous drying medium may be directed past one or more heating elements 162. The drying medium 164 heated by the heating elements 162 is then blown via one or more openings or nozzles 163 onto the surface of the recording medium 120. The delivery rate of the blower 165, and/or the heating power of the one or more heating elements 162, may be controlled or regulated and/or individually set via a controller 161 of the dryer 160, wherein the controller 161 may, if applicable, be part of the controller 101 of the dryer or fuser 150 or of the printing device 100. In particular, the temperature in the surroundings of the recording medium 120 may be detected by means of a temperature sensor 166. The controller 161 may be configured to control or regulate the blower 165 and/or the one or more heating elements 162 depending on sensor data of the temperature sensor 166. For example, a defined temperature in the surroundings of the recording medium 120 may thus be set.

In an exemplary embodiment, the dryer or fuser 150 depicted in FIG. 1*b* also includes one or more radiant dryers 180 that are configured to expose the print image to be fixed with radiation, for example with infrared radiation. The exposure leads to a heating of the ink and of the recording medium 120. The evaporation rate of the water from the ink is thereby typically relatively slow in comparison to the evaporation rate given a convection dryer 160.

Figure 1D:
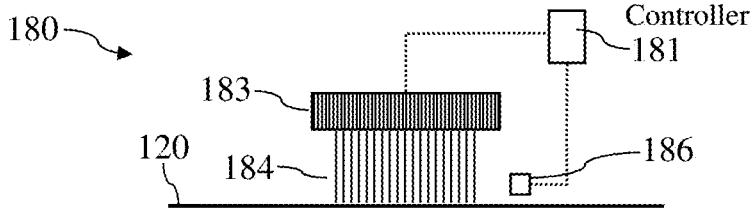

FIG. 1*d* shows an example of a radiant dryer 180, according to an exemplary embodiment, having a radiation source 183 that is configured to generate radiation 184 (for example infrared (IR) radiation) to expose the recording medium 120. The radiation source 183 may include one or more light emitting diodes (LEDs), for example, in particular LEDs for IR radiation. The dryer 180 may include a temperature sensor 186. Furthermore, the dryer 180 may include a controller 181 that is configured to operate the radiation source 183 depending on the sensor data of the temperature sensor 186. For example, the intensity and/or the spatial distribution and/or the spectrum of the radiation 184 may be varied as a fixing parameter.

Furthermore, in an exemplary embodiment, the dryer or fuser 150 depicted in FIG. 1*b* includes one or more thermal conductivity dryers 170 that are configured to heat the recording medium 120 from the (unprinted) back side. A thermal conductivity dryer 170 includes a heated heating surface or a heating saddle over which the back side of the recording medium 120 is directed in order to heat said recording medium 120. A thermal conductivity dryer 170 has an evaporation rate for water that is relatively low in comparison to the evaporation rate given a convection dryer 160.

A dryer or fuser 150 may thus be provided that includes different types of dryers 160, 170, 180 having different evaporation rates for the water in the ink applied onto a recording medium 120. Via the use of different types of dryers 160, 170, 180, and/or via the adaptation or adjustment of fixing parameters of the individual dryers 160, 170, 180, the fixing process of an ink-based print image may be adjusted such that, within the scope of the fixing process, an optimally high proportion of cosolvent diffuses out of the ink, into the interior of the recording medium 120, and thus a qualitatively high-grade and in particular wear-resistant fixed print image may be provided.

In an exemplary embodiment, a dryer or fuser 150 is provided that has a plurality of different fixing parameters, wherein the fixing parameters may be adjusted in order to adapt the fixing process for fixing of a print image to the respective present situation with regard to the absorption of the ink by the recording medium 120 that has been printed to, in particular to the respective present absorption rate. In this document, a method is described that enables the measurement of the absorption rate of a recording medium 120 used in a printing device 100. The measurement thereby takes place directly (and possibly only once) within the printing device 100. The absorption rate determined within the scope of the measurement may be used to adapt values of the one or more fixing parameters of the fuser 150 using a fixing model, in order to generate a robust print image (in which the cosolvent has been absorbed as completely as possible by the recording medium 120).

In particular, absorption data for a defined type of recording medium 120 may be determined, wherein the absorption data indicate the absorption rate of a test fluid as a function of the total quantity of test fluid to be absorbed. The absorption rate may thereby be between, for example, 0.5 μm/√s (given a coated paper) and 50 μm/√s (given an uncoated paper).

Figure 2A:
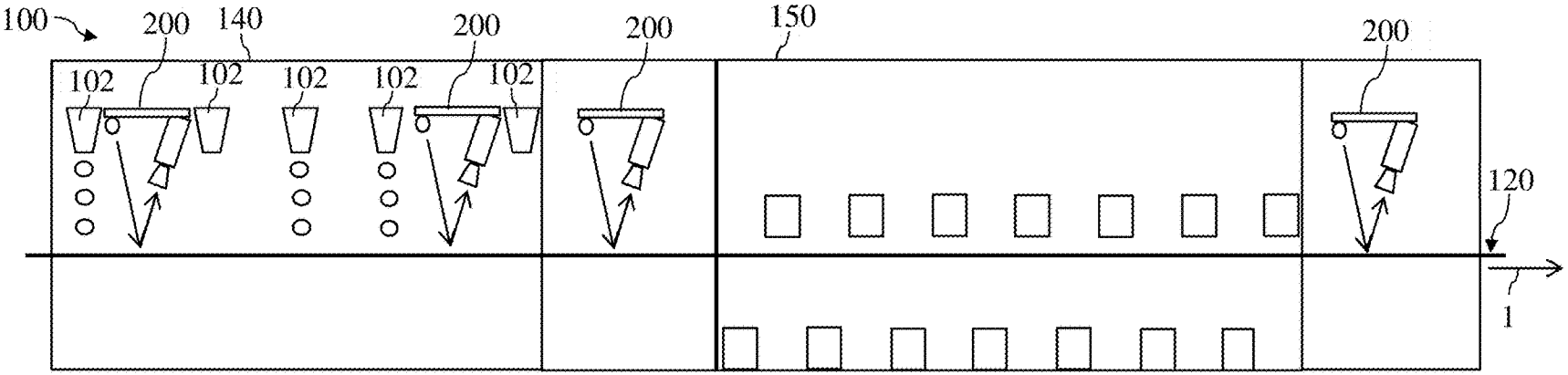
Figure 2B:
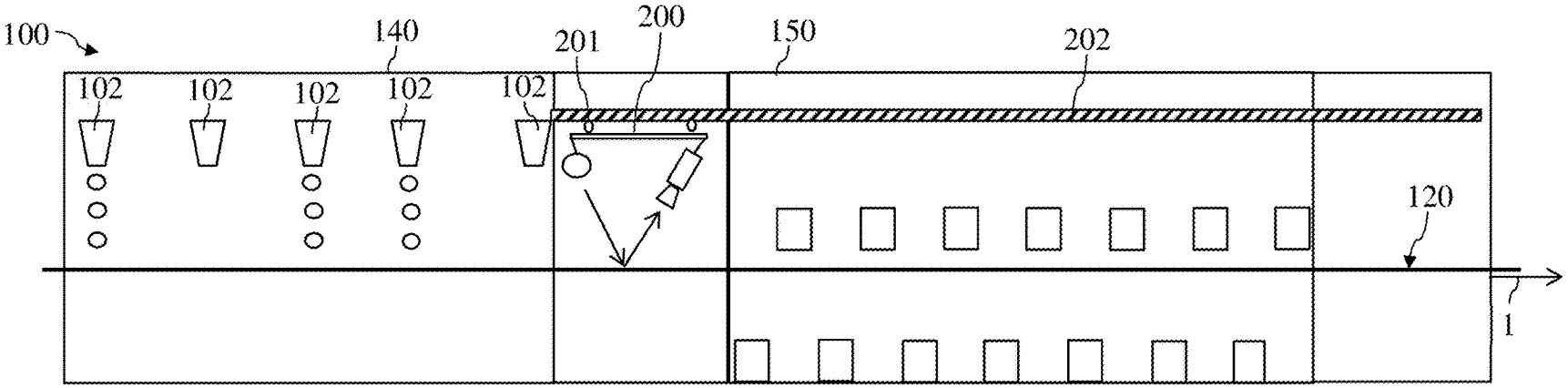
Figure 3:
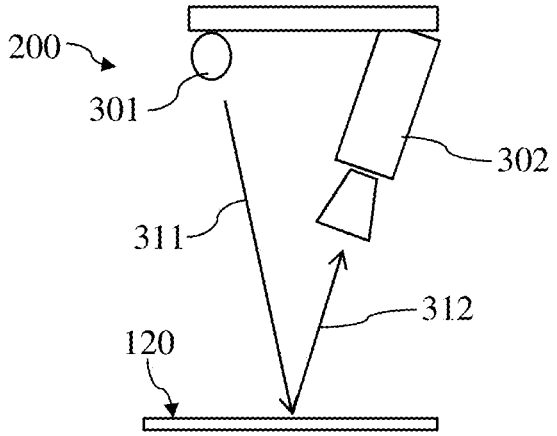
FIG. 3 illustrates an absorption measurement system according to exemplary embodiment.

FIGS. 2*a* and 2*b* show printing devices 100, according to exemplary embodiments, having one or more absorption measurement systems 200. FIG. 3 shows an example of an absorption measurement system 200, according to an exemplary embodiment. The absorption measurement system 200 includes a transmitter 301 that is configured to emit a measurement signal 311 in the direction of the surface of the recording medium 120. The measurement signal 311 may include an optical signal or a light signal. The measurement signal 311 is at least partially reflected on the surface of the recording medium 120. The absorption measurement system 200 includes a signal detector 302 that is configured to detect the reflected portion of the measurement signal 311, meaning the signal 312 reflected on the surface of the recording medium 120, which was reflected in the direction of the signal detector 302. In an exemplary embodiment, the signal detector 302 is an optical sensor and/or a camera. The reflection properties, in particular the gloss, of the surface of the recording medium 120 may thus be determined by means of the absorption measurement system 200. The reflection properties of the surface of the recording medium 120 depend on whether the test fluid is still located on the surface of the recording medium 120 or has already been absorbed by the recording medium 120. In particular, the absorption point in time at which the test fluid was absorbed (entirely, or at least 80%) by the recording medium 120 may be detected by means of the absorption measurement system 200. The absorption time and the absorption rate may be calculated from the duration between the application point in time at which the test fluid was applied onto the recording medium 120 and the absorption point in time at which the test fluid was absorbed by the recording medium 120.

Figure 4:
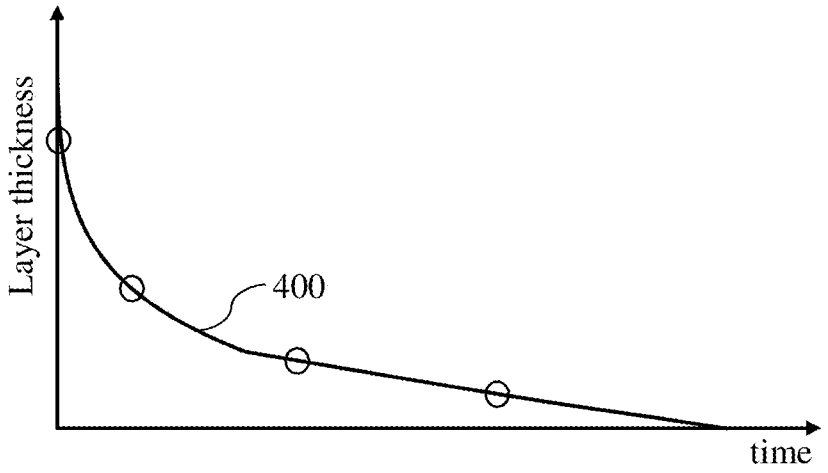
FIG. 4 illustrates absorption data according to exemplary embodiments.

Alternatively or additionally, the time curve of the reflection properties of the surface of the recording medium 120 may be determined using the absorption measurement system 200. Based on this, the time curve 400 of the layer thickness of the test fluid on the surface of the recording medium 120 may then be determined (as depicted by way of example in FIG. 4). A decreasing reflectivity thereby typically indicates a decreasing layer thickness. The layer thickness may thereby indicate how far the test fluid projects above the surface of the recording medium 120. In other words, the layer thickness may indicate the distance between the surface of the test fluid and the surface of the recording medium 120. The layer thickness of the layer of test fluid on the surface of the recording medium 120 typically decreases over time (meaning with progressive absorption by the recording medium 120). The layer thickness is typically highest directly after application of the test fluid on the recording medium 120. Given substantially complete absorption of the test fluid, the layer thickness is typically essentially zero. The complete absorption may be detected precisely and efficiently by an absorption measurement system 200.

The printing device 100 depicted in FIG. 2*a* includes a plurality of absorption measurement system 200 at different, exemplary, measurement positions within the printing device 100. The test fluid (for example ink or a coating substance, for instance primer) may, for example, be applied onto the recording medium 120 by one or more print bars 102 of the print group 140 (in general by an application means). An absorption measurement system 200 may be arranged directly after a print bar 102 (if applicable still within the print group 140) in the transport direction 1. Alternatively or additionally, a respective absorption measurement system 200 may be arranged before or after the fuser 150.

FIG. 2*b* shows a printing device 100 having a movable absorption measurement system 200 that may be moved to different measurement positions within the printing device 100. For example, the printing device 100 may have at least one guide rail 202 that, for example, extends from the print group 140 along the transport direction 1 up to in front of the fuser 150, possibly through the fuser 150, and possibly to behind the fuser 150. The absorption measurement system 200 may be borne so as to be movable on the guide rail 202 and be driven by an actuator 201 (in particular by an electric motor) in order to move the absorption measurement system 200 to different positions within the printing device 100.

To acquire the absorption data, a defined quantity of test fluid (per area unit) or a defined layer thickness of the test fluid may be applied in a test region of the recording medium 120 at an application point in time by the print group 140, for example given a defined transport velocity of the recording medium 120. The test region may, for example, extend over a plurality of columns 31, 32 (for example over the entire print width) over a plurality of lines (for example 5 or more, 10 or more, or 20 or more lines).

The duration up to the (complete, or at least 80%) absorption of the test fluid may then be determined (using the one or more absorption measurement systems 200 of the printing device 100). This duration may be referred to as an absorption time. In order to be able to measure the absorption time, the test region of the recording medium 120 (at which the test fluid has been applied) may be moved by the print group 140 to the measurement position at which the absorption measurement system 200 is arranged. The recording medium 120 may then be stopped in order to hold the test region at the measurement position for the measurement of the (still remaining) absorption time. The total absorption time is thus composed of a transport duration and a measurement duration. The transport duration is the duration between the application point in time at which the test fluid was applied to the test region of the recording medium 120 and the point in time at which the test region has reached the measurement position, and/or as of which the measurement by the absorption measurement system 200 begins. The measurement duration is the duration from the beginning of the measurement by the absorption measurement system 200 up to the point in time at which the (complete, or at least 80%) absorption of the test fluid is detected by the absorption measurement system 200.

In an exemplary embodiment, the absorption rate for the applied fluid quantity is determined from the determined absorption time and the originally applied fluid quantity or layer thickness. The absorption time and/or the absorption rate may be detected for different fluid quantities and/or for different types of test fluids. In particular, the absorption times for different fluid quantities may be detected in order to determine a correlation between the layer thickness and the respective absorption time. The absorption rate of the test fluid on the type of recording medium 120 used may be determined from this correlation based on a model specification for the absorption of fluids in porous media, for example based on Darcy's law.

The determined value of the absorption rate may be used, together with a model of the fixing process, to determine values of the one or more fixing parameters of the fuser 150 of the printing device 100, said values being optimized for the type of recording medium 120 used. The model of the fixing process may include an analytical and/or machine-learning model. The model for the fixing process may be determined in advance (for example experimentally). The values of the one or more fixing parameters, said values being determined on the basis of the model for the fixing process, may be offered for acceptance as default or preset values to a user of the printing device 100 via a user interface of the printing device 100.

The application of the test fluid may, for example, take place via a print bar 102 or via a print head 103 or via a roller, a slot nozzle, and/or by means of a curtain coating. The transport velocity of the recording medium 120 may be adapted as needed within the scope of the measurement of the absorption time, for example in order to vary the quantity of the test fluid applied onto the recording medium 120. Ink, a coating substance (in particular a primer), and/or another fluid that can be applied onto the recording medium 120 may be used as a test fluid. The absorption behavior of the ink used for printing may be concluded under consideration of the chemical composition of the test fluid used for the measurement.

The absorption data may be detected for different types of test fluids and/or for differently composed test fluids. These absorption data may then be used, together with the model of the fixing process, to determine with increased precision the values to be used for the one or more fixing parameters.

A fixed measurement position may be used for relatively low absorption rates (as depicted in FIG. 2*a*). The measurement position may be such that the recording medium 120 may be moved with a defined transport velocity from the application position (at which the test fluid is applied) to the measurement position (at which the absorption measurement system 200 is arranged) using the transport duration, and may be stopped at the measurement position. The remaining measurement duration up to the (complete, or at least 80%) absorption of the test fluid may then be measured at the measurement position by means of the absorption measurement system 200. The absorption time then results as a sum of transport duration and measurement duration.

For relatively high absorption rates, it may be necessary that the measurement of the absorption be started immediately after the application of the test fluid, even for relatively large fluid quantities. Given relatively high absorption rates, the absorption time may be short, such that the recording medium 120 may not be stopped within the available absorption time. In this instance, as depicted in FIG. 2*b*, a movable absorption measurement system 200 may be used. The absorption measurement system 200 may then be moved, above the test region of the recording medium 120 in which the test fluid is located, synchronously with the recording medium 120 in order to determine the absorption point in time at which the test fluid is absorbed by the recording medium 120. The synchronous movement of the absorption measurement system 200 may in particular be used when only a spatially delimited marking with test fluid is applied onto the recording medium 120.

If applicable, test fluid may be applied onto the (moving) recording medium 20 at the application position over a relatively long time period of time so that a relatively long stripe of test fluid, traveling in the transport direction 1, is applied onto the recording medium 120. By means of a movable absorption measurement system 200, the location (after the application position in the transport direction 1) may then be sought at which and/or as of which the test fluid has been (completely, or at least 80%) absorbed by the recording medium 120. The absorption time and/or the absorption rate of the test fluid may then be precisely determined on the basis of the distance between the identified location (which is also referred to as the absorption position in this document) and the application position, and on the basis of the transport velocity of the recording medium 120.

Figure 2C:
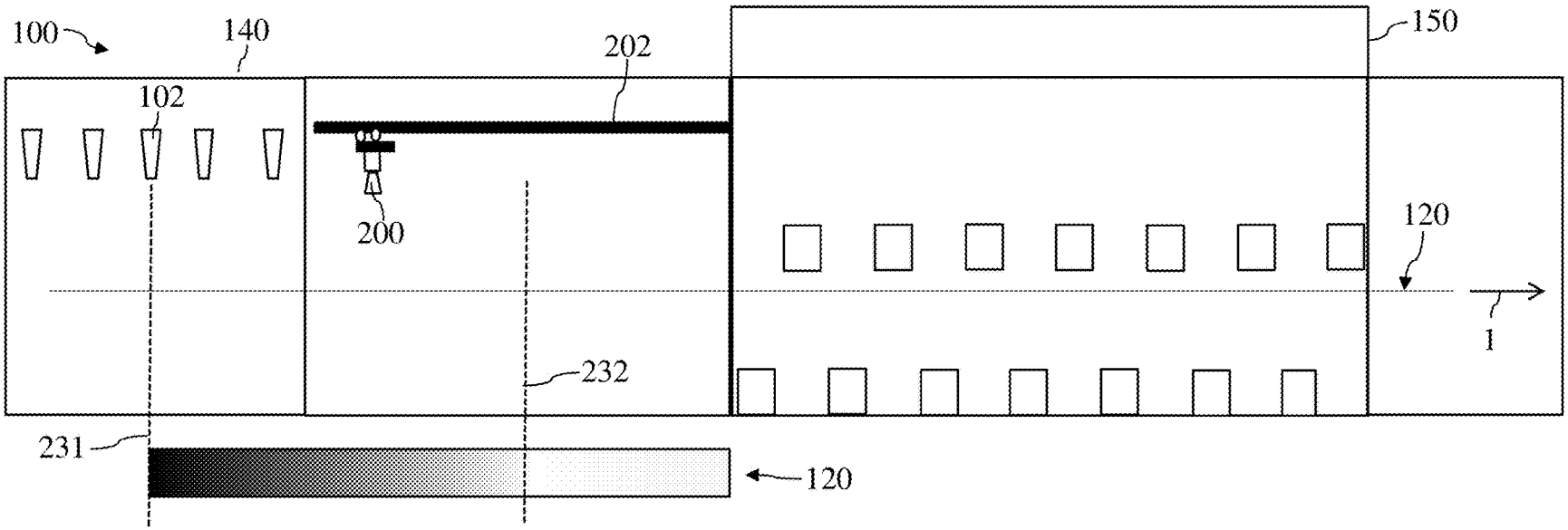

FIG. 2*c* shows a printing device 100, according to an exemplary embodiment, having an absorption measurement system 200 that may be moved along a guide rail 202. In the example depicted in FIG. 2*c*, the test fluid is applied onto the recording medium 120 by the print bar designated with the reference character 102. The test fluid is applied onto the recording medium 120 at the application position 231.

Moreover, below the printing device 100 FIG. 2*c* shows the surface of the recording medium 120 starting from the application position 231, up to the beginning of the fuser 150. A relatively dark inking of the recording medium 120 thereby illustrates that test fluid is located on the surface of the recording medium 120. The decreasing inking of the recording medium 120 should illustrate how test fluid is absorbed by the recording medium 120 little by little with increasing distance from the application position 231, until finally the test fluid has been essentially entirely (for example up to 80% or more) absorbed by the recording medium 120 at the absorption position 232, so that essentially test fluid is no longer located on the surface of the recording medium 120. The absorption position 232 is thereby the location situated closest to the application position 231 at and/or as of which the test fluid has been substantially (for example up to 80% or more) absorbed by the recording medium 120. The absorption position 232 may be detected in that the absorption measurement system 200 is moved along the transport direction 1 to different positions or locations and measurement data (for example the intensity of a reflected signal 312) are respectively acquired.

The absorption time and/or the absorption rate of a recording medium 120 may be particularly efficiently and precisely determined via a continuous application of test fluid and via the detection of the absorption position 232.

In this document, a printing device 100 (for example an inkjet printing device) for printing to a recording medium 120 is thus described. The printing device 100 may be used for printing to different types of recording media 120. The printing device 100 includes at least one print head 103 that is configured to apply print color (in particular ink) for a print image onto the recording medium 120. In particular, the printing device 100 may have one or more print bars 102 with respectively one or more print heads 103, wherein a respective print color may be applied onto the recording medium 120 by each print bar 102.

Furthermore, the printing device 100 includes a fuser 150 that is configured to execute a fixing process in order to at least partially fix the print image onto the recording medium 120. The fuser 150 thereby has at least one adjustable fixing parameter via which the fixing process may be varied. The goal of the fixing process may be to produce the effect that cosolvent (in particular glycerin) contained in the print color is optimally entirely absorbed by the recording medium 120 (and the print image is optimally completely dried).

The fuser 150 may have a fixing or drying route along which are arranged one or more dryers 160, 170, 180 that are respectively configured to transfer thermal energy to the recording medium 120 in order to fix or dry the print image on the recording medium 120. Examples of dryers 160, 170, 180 are the convection dryers 160, thermal conductivity dryers 170, and/or radiant dryers 180 described in this document. A convection dryer 160 may thereby be configured to direct a gaseous drying medium 164 onto the recording medium 120 to dry a print image. A thermal conductivity dryer 170 may have a heating saddle to heat the recording medium 120. A radiant dryer 180 may configured to direct radiation 184 toward the recording medium 120.

Examples of adjustable fixing parameters (but not limited to) are: the temperature and/or the volumetric flow and/or a (chemical) composition (for example a proportion of moisture and/or a gas that is used) of the gaseous dryer 164 of a convection dryer 160 of the fuser; the frequency and/or the intensity of a radiation 184 produced by a radiant dryer 180 of the fuser 150; and/or the temperature and/or a heating capacity of the heating saddle or of the heating element of a thermal conductivity dryer 170 of the fuser 150 that is in contact with the recording medium 120. If applicable, the fuser 150 may have a plurality of dryers 160, 170, 180 along the drying and/or fixing route. The dryers 160, 170, 180 may be configured to act on the (printed) front side of the recording medium 120 and/or on the (possibly unprinted) back side of the recording medium 120. Additional examples of fixing parameters are: the number and/or the arrangement of activated convection dryers 160, thermal conductivity dryers 170, and/or radiant dryers 180 within the fuser 150.

Furthermore, the printing device 100 may include a transport means that is configured to move the recording medium 120 along the transport direction 1, from the at least one print head 103 to the fuser 150. For example, a recording medium 120 in the form of a web may be drawn through the printing device 100 along the transport direction 1. A recording medium 120 in the form of a sheet or page or plate may be moved through the printing device 100 by means of a transport belt.

Moreover, the printing device 100 includes an application means that is configured to apply a test fluid onto the recording medium 120. Examples of application means are an application roller or a print head (having one or more nozzles). Examples of test fluids are inks or a coating substance (for instance primer). In a preferred embodiment, the application means corresponds to the print head 103 for printing of the print image. Furthermore, in a preferred embodiment the test fluid corresponds to the print color with which the print image is printed onto the recording medium 120. The one or more fixing parameters of the fuser 150 of the printing device 100 may thus be particularly precisely adjusted.

Furthermore, the printing device 100 includes at least one absorption measurement system 200 that is configured to acquire absorption data with regard to the absorption rate with which the test fluid is absorbed by the recording medium 120. The absorption measurement system 200 may be designed as described in connection with FIG. 3. In particular, the absorption measurement system 200 may be designed to detect an absorption point in time at which the test fluid has been essentially entirely (for example up to 80% or more) absorbed by the recording medium 120. This may in particular be detected based on the fact that the surface of the recording medium 120 has a relatively high gloss value if test fluid is located on the surface and a relatively low gloss value if (essentially) no test fluid is located on the surface. Alternatively or additionally, the (complete or at least 80%) absorption of the test fluid may be detected on the basis of the wetness of the surface of the recording medium 120, wherein the surface of the recording medium 120 is still wet as long as test fluid is still located on the surface of the recording medium 120, and wherein the surface of the recording medium 120 is no longer wet and/or is dry if the test fluid has been (at least 80%) absorbed by the recording medium 120. The wetness of the surface of the recording medium 120 may, for example, be determined on the basis of a conductivity measurement.

The printing device 100 also includes a controller 101 that is configured to determine a value of the at least one fixing parameter on the basis of the absorption data. The value of the fixing parameter may possibly be set automatically, meaning that the value of the fixing parameter may possibly be automatically adopted by the fuser 150 and the fuser 150 may be operated with the (automatically set) value of the fixing parameter. In particular, the fuser 150 may be operated with the determined value of the fixing parameter during the printing operation of the printing device 100 (given use of the defined type of recording medium 120 for which the value of the fixing parameter was determined).

The printing device 100 described in this document thus includes an application means with which a test fluid is applied onto a recording medium 120 to be printed to, as well as an absorption measurement system 200 with which absorption data are acquired with regard to the absorption rate of the test fluid. The printing device 100 also includes a fuser 150 to fix a print image printed by the printing device 100. The fuser 150 may be adjusted, depending on the acquired absorption data, so that a reliable fixing of print images on the respectively used type of recording medium 120 is produced. In particular, it is enabled to adjust the operation of the fuser 150 of a printing device 100 efficiently and reliably to different types of recording media 120 (having respectively different absorption properties).

The controller 101 may be configured to induce the application means to apply test fluid onto a test region of the recording medium 120 at an application point in time. Furthermore, the transport means may be induced to move the test region of the recording medium 120 up to the absorption measurement system 200 (which may be arranged at a measurement position arranged after the application means, in the transport direction 1). Furthermore, the absorption measurement system 200 may be induced to detect the absorption point in time at or as of which the test fluid has been at least partially (for example up to 80% or more) absorbed by the recording medium 120. The absorption point in time may be the point in time at which it is detected for the first time that the test fluid has been absorbed (for example up to 80% or more) by the recording medium 120.

For example, the absorption point in time may be detected as the point in time at which a measurand detected by the absorption measurement system 200 falls below a defined measurand threshold or exceeds a defined measurand threshold. An example of a measurand is the intensity of a signal 312 reflected at the surface of the recording medium 120, and/or the conductivity of the surface of the recording medium 120.

The absorption time required for absorption of the test fluid may be determined on the basis of the duration between the application point in time and the absorption point in time (in particular as the time interval between the application point in time and the absorption point in time). The absorption data (in particular the absorption rate) may then be precisely determined on the basis of the absorption time (for example by means of Dacry's law.

The absorption measurement system 200 may be installed stationary at the measurement position within the printing device 100. The controller 101 may be configured to induce the transport means to stop the movement of the recording medium 120 as soon as the test region of the recording medium 120 has reached the measurement position. The test region of the recording medium 120 may then be held stationary in the acquisition region of the absorption measurement system 200, for example until the absorption point in time is detected. The use of a stationary absorption measurement system 200 is in particular advantageous given recording media 120 having a relatively low absorption rate.

Alternatively or additionally, the printing device 100 may include an actuator 201 (in particular an electric motor) that is configured to move the absorption measurement system 200 along the transport direction 1. The controller 101 may be configured to induce the actuator 201 to move the absorption measurement system 200 in the transport direction 1, if applicable synchronously with the test region of the recording medium 120. In particular, the absorption measurement system 200 may be moved with the same transport velocity as the recording medium 120. The absorption measurement system 200 may be moved such that the test region of the moved recording medium 120 remains within the acquisition region of the absorption measurement system 200. A movable absorption measurement system 200 may be arranged relatively close to (for example immediately after) the application position 231 of the application means. The use of a movable absorption measurement system 200 is in particular advantageous given recording media 120 having a relatively high absorption rate.

Alternatively, a test region may be printed that has a relatively large propagation along the transport direction 1. The absorption measurement system 200 may then be moved along the transport direction 1 toward a position of the recording medium 120 that is situated as close as possible to the application position 231, and at which an essentially complete absorption of the test fluid is detected by the absorption measurement system 200. The detected location may be referred to as the absorption position 232. The absorption time required for absorption of the test fluid may then be calculated from the distance between the determined location (meaning the absorption position 232) and the application position 231 and from the transport velocity of the recording medium 120 (in particular from the quotient of the distance and the transport velocity).

The controller 101 may thus be configured to induce the application means (arranged at the application position 231) to essentially continuously apply test fluid onto the recording medium 120 while the recording medium 120 is moved past the application means with a defined transport velocity in the transport direction 1. Furthermore, the controller 101 may be configured to induce the absorption measurement system 200 to be moved to different locations (after the application means, in the transport direction 1) in order to detect the absorption position 232 at which and/or as of which (with regard to the transport direction 1) the test fluid applied onto the recording medium 120 has been essentially entirely absorbed by the recording medium 120. The absorption data may then be precisely determined on the basis of the distance between the recording medium 231 and the absorption position 232, and/or on the basis of the transport velocity.

The controller 101 may be configured to induce the application means to apply different quantities of the test fluid in different test regions of the recording medium 120. This may be produced in particular by varying the transport velocity of the recording medium 120. Alternatively or additionally, test fluid may be applied from a varying number of print heads 103 in order to vary the fluid quantity. If applicable, a repeated application of test fluid may take place from a print head 103 (via forward and backward movement of the recording medium 120). Alternatively or additionally, the droplet size of the droplets of test fluid ejected by a print head 103 may be varied (via the adaptation of the waveform with which the individual nozzles 21, 22 of a print head 103 are activated). The layer thickness of the layer of test fluid that was (originally) applied onto the recording medium 120 may thus be varied. The applied quantity of test fluid thereby typically increases with increasing layer thickness. On the other hand, an increase in the applied quantity of test fluid typically leads to an increasing layer thickness.

Furthermore, the absorption measurement system 200 may be induced to acquire absorption data with regard to the absorption rate of the test fluid in the different sub-regions of the recording medium 120, and/or for the different quantities of test fluid. A correlation may thus be determined between the total quantity of test fluid that must be absorbed by the recording medium 120 and the absorption rate and/or absorption time that is/are respectively present for the different quantities. The value of the at least one fixing parameter may then be determined particularly precisely on the basis of the absorption rates and/or the absorption times for the different quantities of test fluid.

A recording medium 120 may possibly have a plurality of different layers (for example a base layer and one or more layers of coating). Such a layer structure may lead to the situation that the recording medium 120 has different absorption rates for different quantities of test fluid. The absorption behavior of a (multilayer) recording medium 120 may thus be precisely determined by measuring the absorption rates and/or the absorption times (i.e. the absorption data) for different quantities of test fluid. This in turn enables the values of the one or more fixing parameters to be particularly precisely adapted to a defined type of recording medium 120.

Alternatively or additionally, the controller 101 may be configured to induce the application means to apply different test fluids with different compositions in different test regions of the recording medium 120. For example, this may be produced via different print heads 103 or print bars 102. The absorption measurement system 200 may be induced to acquire absorption data with regard to the absorption rate of the test fluid in the different sub-regions of the recording medium 120. Respective present absorption times and/or absorption rates may thus be determined for different test fluids. The value of the at least one fixing parameter may then be particularly precisely determined on the basis of the absorption rates and/or the absorption times for the different test fluids.

The controller 101 may be configured to determine the value of the at least one fixing parameter on the basis of a model of the fixing process. The model of the fixing process may depend on the determined absorption data. In particular, the model may be configured to provide respectively different (optimized) values of the at least one fixing parameter for different absorption data. An optimized value of the at least one fixing parameter may be determined particularly precisely by using a model.

The model of the fixing process may include an analytical and/or machine-learning model. The model, in particular the analytical model, may, for example, have one or more formulas and/or correlations and/or characteristic curves between different values of the one or more absorption rates and/or absorption times on the one hand, and different values of the at least one fixing parameter on the other hand.

A machine-learning model may, for example, include a neural network having a plurality of neurons. The parameters of the neurons may have been trained on the basis of training data. The training data may have a plurality of training data sets. A training data set may thereby respectively have actual values of the one or more measured absorption rates and/or absorption times on the one hand, and matching thereto an (optimized) value of the at least one fixing parameter. The machine-learning model may thus have been trained in order to provide an optimized value of the at least one fixing parameter on the basis of the absorption data.

The controller 101 may be configured to determine absorption data during the running printing process of the printing device 100, and to adapt and/or set the at least one fixing parameter of the fuser 150 to fix a print image printed during the running printing process according to the value of the fixing process that was determined on the basis of the absorption data. The absorption data may thereby be advantageously determined on the basis of the print image itself. An adaptation of values of one or more fixing parameters may thus take place during a running printing process. Fluctuations of the properties of the recording medium 120 and/or of the print color may thus be taken into account and be at least partially compensated.

With the measures described in this document, it is enabled to determine the absorption properties of a test fluid (which, for example, includes a cosolvent and/or water) on an unknown type of recording medium 120 inline within a printing device 100. The determined absorption properties may be used to adapt the one or more fixing parameters of the fuser 150 of the printing device 100 such that the robustness of the print image on the type of recording medium 120 that is used is optimized.

The printing device 100 may be configured to determine the absorption rate given use of the actual printing speed or transport velocity. In particular, the absorption rate may possibly be determined directly, inline during the running printing operation. Variations of the absorption rate (caused by fluctuations of properties of the recording medium 120 that is used and/or of the ink that is used, for example) may thus be corrected. The quality of the print image of a printing device 100 may thereby be further increased.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction (of the recording medium)
21, 22 nozzle
31, 32 column (of the print image)
100 printing device
101 controller
102 print bar
103 (usable) print head
120 recording medium
140 print group
150 fuser or dryer
160 convection dryer
161 controller
162 heating element
163 nozzle
164 tempered drying medium (fluid, in particular air)
165 blower
166 temperature sensor
170 thermal conductivity dryer
180 radiant dryer
181 controller
183 radiation source
184 radiation
186 temperature sensor
200 absorption measurement system
201 actuators
202 guide rail
231 application position
232 absorption position
301 transmitter
302 signal detector
311 measurement signal
312 reflected signal
400 layer thickness/absorption time curve

The invention claimed is:

1. A printing device for printing to a recording medium, comprising:

at least one print head that is configured to apply print color for a print image onto the recording medium;

a fuser that is configured to execute a fixing process to at least partially fix the print image onto the recording medium, the fuser including at least one adjustable fixing parameter via which the fixing process is varied;

a transporter that is configured to move the recording medium along a transport direction from the at least one print head to the fuser;

an applicator that is configured to apply a test fluid onto the recording medium;

an absorption measurement system that is configured to determine one or more reflection properties of a surface of the recording medium to acquire absorption data associated with an absorption rate with which the test fluid is absorbed by the recording medium; and a controller that is configured to determine a value of the at least one fixing parameter based on the absorption data, and to control the fuser based on the value of the at least one fixing parameter.

2. The printing device according to claim 1, wherein the controller is configured to:

induce the applicator, at an application point in time, to apply the test fluid onto a test region of the recording medium;

induce the transporter to move the test region of the recording medium up to the absorption measurement system;

induce the absorption measurement system to detect an absorption point in time at which the test fluid applied onto the test region has been entirely absorbed by the recording medium; and determine the absorption data based on a duration between the application point in time and the absorption point in time.

3. The printing device according to claim 2, wherein:

the absorption measurement system is stationarily installed at a measurement position within the printing device; and the controller is configured to induce the transporter to stop movement of the recording medium in response to the test region of the recording medium reaching the measurement position.

4. The printing device according to claim 2, further comprising an actuator configured to move the absorption measurement system along the transport direction, wherein:

the absorption measurement system is arranged after the applicator in the transport direction; and the controller is configured to induce the actuator to move the absorption measurement system, along the transport direction, synchronously with the test region of the recording medium.

5. The printing device according to claim 1, wherein the controller is configured to:

induce the applicator to apply different quantities of the test fluid in different test regions of the recording medium; and induce the absorption measurement system to acquire absorption data associated with the absorption rate of the test fluid in the different test regions of the recording medium.

6. The printing device according to claim 1, wherein the controller is configured to:

induce the applicator to apply different test fluids with different compositions in different test regions of the recording medium; and induce the absorption measurement system to acquire absorption data associated with the absorption rate of the respective different test fluids in the different test regions of the recording medium.

7. The printing device according to claim 1, wherein:

the controller is configured to determine the value of the at least one fixing parameter based on a model of the fixing process;

the model of the fixing process depends on the absorption data; and the model of the fixing process comprises an analytical and/or a machine-learning model.

8. The printing device according to claim 1, wherein the at least one fixing parameter comprises:

a temperature and/or a volumetric current and/or a composition of a gaseous drying medium of a convection dryer of the fuser that is configured to direct the gaseous drying medium toward the recording medium to dry the print image;

a frequency and/or an intensity of a radiation produced by a radiant dryer of the fuser to dry the print image on the recording medium;

a temperature and/or a heating capacity of a thermal conductivity dryer of the fuser that has a heating element that is in contact with the recording medium; and/or a number and/or an arrangement of activated convection dryers, thermal conductivity dryers, and/or radiant dryers.

9. The printing device according to claim 1, wherein the at least one fixing parameter comprises:

a temperature and/or a volumetric current and/or a composition of a gaseous drying medium of a convection dryer of the fuser that is configured to direct the gaseous drying medium toward the recording medium to dry the print image;

a frequency and/or an intensity of a radiation produced by a radiant dryer of the fuser to dry the print image on the recording medium;

a temperature and/or a heating capacity of a thermal conductivity dryer of the fuser that has a heating element that is in contact with the recording medium; and a number and/or an arrangement of activated ones of the convection dryers, thermal conductivity dryers, and/or radiant dryers.

10. The printing device according to claim 1, wherein:

the applicator comprises the at least one print head;

the test fluid comprises a print color that is used for the printing of the print image; and/or the test fluid and/or the print color respectively comprise ink.

11. The printing device according to claim 1, wherein:

the applicator comprises the at least one print head;

the test fluid comprises a print color that is used for the printing of the print image; and the test fluid and/or the print color respectively comprise ink.

12. The printing device according to claim 1, wherein the controller is configured to:

determine absorption data during a running printing process of the printing device; and adapt and/or adjust, according to the value determined based on the absorption data, the at least one fixing parameter of the fuser to fix a print image printed during the running printing process.

13. The printing device according to claim 1, wherein the one or more reflection properties of the surface of the recording medium comprise a degree of glossiness of the surface of the recording medium.

14. The printing device according to claim 13, wherein the degree of glossiness is inversely correlated to a degree at which the test fluid has been absorbed by the recording medium.

15. The printing device according to claim 1, wherein the absorption measurement system comprises a signal detector that is configured to detect a reflected portion of a signal reflected by the surface of the recording medium to determine the one or more reflection properties.

16. The printing device according to claim 15, wherein the signal detector is an optical sensor.

17. The printing device according to claim 1, wherein the absorption measurement system is further configured to determine a conductivity of the surface of the recording medium to acquire the absorption data.

18. The printing device according to claim 17, wherein the conductivity is inversely correlated to a degree at which the test fluid has been absorbed by the recording medium.

19. A printing device for printing to a recording medium, comprising:

at least one print head that is configured to apply print color for a print image onto the recording medium;

a fuser that is configured to execute a fixing process to at least partially fix the print image onto the recording medium, the fuser including at least one adjustable fixing parameter via which the fixing process is varied;

a transporter that is configured to move the recording medium along a transport direction from the at least one print head to the fuser;

an applicator that is configured to apply a test fluid onto the recording medium;

an absorption measurement system that is configured to acquire absorption data associated with an absorption rate with which the test fluid is absorbed by the recording medium; and a controller that is configured to:

determine a value of the at least one fixing parameter based on the absorption data, and to control the fuser based on the value of the at least one fixing parameter;

induce the applicator, at an application point in time, to apply the test fluid onto a test region of the recording medium;

induce the transporter to move the test region of the recording medium up to the absorption measurement system;

induce the absorption measurement system to detect an absorption point in time at which the test fluid applied onto the test region has been entirely absorbed by the recording medium; and determine the absorption data based on a duration between the application point in time and the absorption point in time, wherein:

(a) the absorption measurement system is stationarily installed at a measurement position within the printing device, and the controller is configured to induce the transporter to stop movement of the recording medium in response to the test region of the recording medium reaching the measurement position; or (b) the printing device further comprises an actuator configured to move the absorption measurement system along the transport direction, the absorption measurement system being arranged after the applicator in the transport direction, and the controller being configured to induce the actuator to move the absorption measurement system, along the transport direction, synchronously with the test region of the recording medium.

20. A printing device for printing to a recording medium, comprising:

at least one print head that is configured to apply print color for a print image onto the recording medium;

a fuser that is configured to execute a fixing process to at least partially fix the print image onto the recording medium, the fuser including at least one adjustable fixing parameter via which the fixing process is varied;

a transporter that is configured to move the recording medium along a transport direction from the at least one print head to the fuser;

an applicator that is configured to apply a test fluid onto the recording medium;

an absorption measurement system that is configured to acquire absorption data associated with an absorption rate with which the test fluid is absorbed by the recording medium; and a controller that is configured to:

determine a value of the at least one fixing parameter based on the absorption data, and to control the fuser based on the value of the at least one fixing parameter;

induce the applicator to apply different quantities of the test fluid in different test regions of the recording medium; and induce the absorption measurement system to acquire absorption data associated with the absorption rate of the test fluid in the different test regions of the recording medium.

* * * * *